United States Patent [19]

Killen

[11] 4,183,522

[45] Jan. 15, 1980

[54] MINIATURE ADJUSTABLE BASKETBALL GOAL WITH APERTURED SUPPORT BARS

[76] Inventor: Alston H. Killen, Macon, Ga.

[21] Appl. No.: 868,676

[22] Filed: Jan. 11, 1978

[51] Int. Cl.[2] ..... A63B 63/04

[52] U.S. Cl. ..... 273/1.5 R; 211/105.1; 248/475 R

[58] Field of Search ..... 273/1.5 R, 105 R, 85 R, 273/102 S; 108/29, 31, 109; 272/62; 211/105.1; 248/441 B, 475 R, 466

[56] References Cited

U.S. PATENT DOCUMENTS

| | | | |
|---|---|---|---|
| 2,534,067 | 12/1950 | Rubin | 273/1.5 R |
| 2,622,541 | 12/1952 | Smart | 211/162 |
| 2,707,104 | 4/1955 | Killick | 273/1.5 R |
| 2,932,516 | 4/1960 | Penner | 273/105 R |
| 3,050,304 | 8/1962 | Hulsebus | 273/1.5 R |
| 3,137,502 | 6/1964 | Duganich | 273/1.5 R |
| 3,219,302 | 11/1965 | Smith | 248/466 |
| 3,222,018 | 12/1965 | Masters | 248/475 R |
| 3,462,143 | 8/1969 | Bidelman et al. | 273/1.5 R |
| 3,650,530 | 3/1972 | Gantz | 273/1.5 R |
| 3,685,662 | 8/1972 | Varan et al. | 211/105.1 |
| 3,970,304 | 7/1976 | Ebstein et al. | 273/1.5 R |
| 4,067,536 | 1/1978 | McBeth | 248/475 R |

FOREIGN PATENT DOCUMENTS

| | | | |
|---|---|---|---|
| 227226 | 9/1958 | Austria | 108/109 |
| 627208 | 5/1963 | Belgium | 273/1.5 R |
| 901749 | 1/1954 | Fed. Rep. of Germany | 272/63 |
| 873739 | 7/1961 | United Kingdom | 108/109 |

*Primary Examiner*—Richard C. Pinkham
*Assistant Examiner*—Lawrence E. Anderson
*Attorney, Agent, or Firm*—Newton, Hopkins & Ormsby

[57] ABSTRACT

A pair of spaced apertured channel members are attached fixedly near their ends to a door or vertical wall surface. A lower pair of support brackets connected as a unit by a trough or channel member have suspension hooks which are engageable releasably in selected apertures of the two apertured channel members. A goal backboard having marginal molding strips has its lower edge socketed in the trough interconnecting the lower pair of support brackets. An upper pair of independent support brackets are bolted directly to upper corners of the backboard and have suspension hooks which engage releasably in apertures of the apertured channel members at an elevation above the lower pair of support brackets. The customary hoop or goal is attached centrally to the backboard by an integral hoop bracket and bolts. Simplicity, sturdiness and economy are featured.

9 Claims, 3 Drawing Figures

MINIATURE ADJUSTABLE BASKETBALL GOAL WITH APERTURED SUPPORT BARS

BACKGROUND OF THE INVENTION

Miniature basketball goals for mounting on doors or for attachment to full size goals are known in the prior art, and some examples of the patented prior art are contained in the following U.S. patents:

U.S. Pat. No. Re-20,898
U.S. Pat. No. 2,517,463
U.S. Pat. No. 2,707,104
U.S. Pat. No. 2,889,149.

The prior art miniature goals have tended to be lacking in stability and in durability particularly the types of goals which are hung from the top edge of a door by a suspension bracket and rest against a vertical face of the door. These structures will not remain fixed during use and they are fragile and their continued movement during usage has a tendency to scratch the door on which they are mounted. Other known types of miniature goals are unduly complex and costly and therefore are not entirely practical in meeting the needs of a miniature goal which is both sturdy and economical, easily adjustable without relying on friction to hold the device in selected adjusted positions, stable during use, and clean and attractive in appearance.

The simple objective of this invention is to completely satisfy all of these requirements or needs in an indoor miniature basketball goal which is completely practical and convenient to install and adjust and which will be stable after adjustment at the desired height. The goal according to the invention can be easily mounted on a wall surface or on a door, requiring only four mounting screw openings which can be filled after dismounting the invention. There is no movement of the goal structure to scratch the door or wall while it is being used.

The backboard of the goal is a scaled-down version of one that is utilized in official adult competition. The remaining components of the goal, namely the hoop and net, may conform in size to those used in an official competitive goal or may be scaled down like the backboard. The miniature basketball goal of the present invention is not only beneficial for use by young people but may be used by adults for an amusing diversity from everyday business details encountered in their occupations or as a game of challenge in places of social leisure such as clubs, taverns, game rooms and the like.

Other features and advantages of the invention will become apparent during the course of the following detailed description.

DETAILED DESCRIPTION

Figure 1:
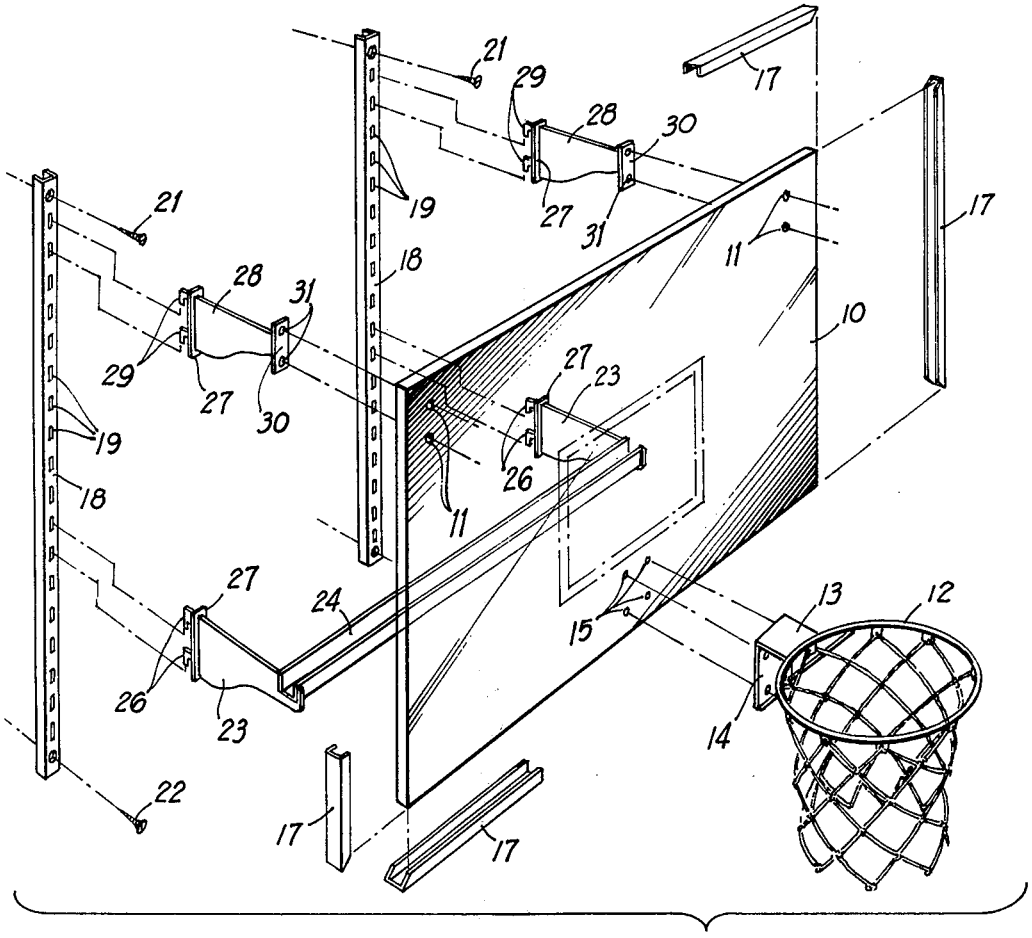
FIG. 1 is an exploded perspective view of the invention.

Referring to the drawings in detail, wherein like numerals designate like parts, the numeral 10 designates a miniature backboard of a realistic basketball goal according to the invention. Near its upper corners, the backboard 10 has pairs of vertically spaced apertures 11 for a purpose to be fully described. The backboard 10 is preferably formed from plexiglas. A substantially conventional miniature goal or hoop 12 having an integral right angular hoop mounting bracket 13 has its vertical leg 14 apertured at four points to register with like apertures 15 provided in the backboard 10 near and above its bottom edge and at its transverse center. Bolts 16 are utilized to rigidly attach the bracket 13 to the backboard so that the hoop 12 will be firmly supported and braced in a plane perpendicular to the backboard 10. The backboard has marginal edge channel-like plastic molding strips 17 applied thereto at all four marginal edges to give the transparent backboard a framed appearance.

A pair of vertical laterally spaced channel mounting bars 18 is provided in lengths suitable to allow a desired range of vertical adjustment for the miniature goal. The mounting bars 18 are conveniently made from commercial shelf support channel members or standards, each member 18 having a multiplicity of equidistantly vertically spaced and vertically elongated apertures 19 formed therein, as illustrated in the drawings. The mounting bars 18 are rigidly attached to any vertical wall 20, door or the like by pairs of screws 21 and 22 near the top and bottom ends of the bars 18, in parallel spaced relationship.

Figure 2A:
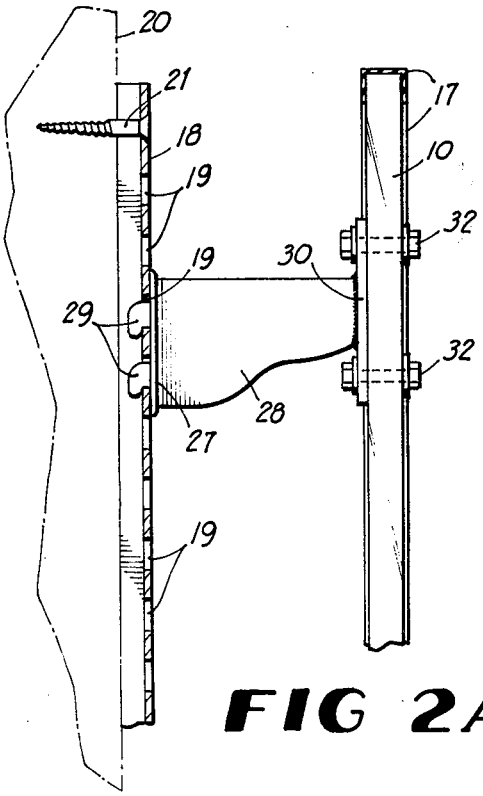
FIG. 2A is a fragmentary vertical section taken in the plane of one upper support bracket and associated elements.
Figure 2B:
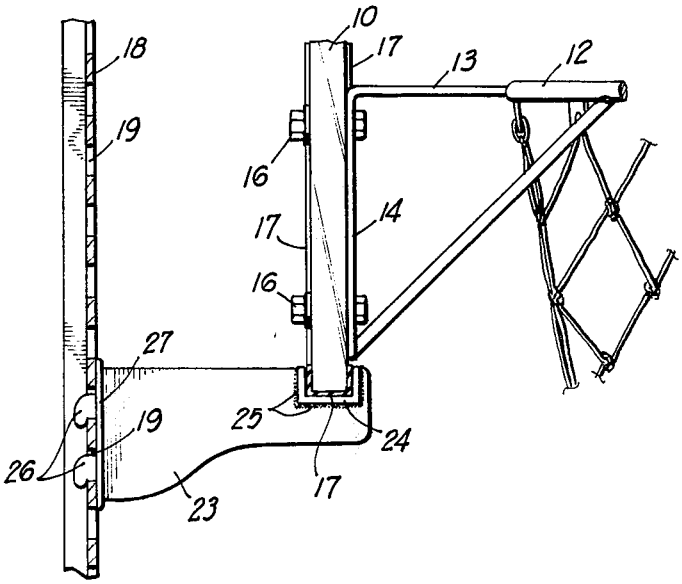
FIG. 2B is a similar cross sectional view taken in the plane of one lower support bracket, partly in elevation.

A lower pair of shelf-type mounting brackets 23 are interconnected in a rigid unitized subassembly by a transverse horizontal upwardly opening channel bar 24 whose opposite ends are seated in notches formed in the tops of the brackets 23 near their forward ends, and permanently welded in said notches as indicated at 25, FIG. 2B. Preferably, the end faces of the bar 24 are flush with the outer side faces of the plate-like vertical brackets 23. The brackets 23 have rear end vertically spaced suspension hooks 26 and coacting vertical abutment plates 27 fixed thereon as is customary in shelf-type commercial adjustable support brackets. The hooks 26 are engageable releasably in selected pairs of the apertures 19 in vertical mounting bars 18. The lower transverse edge of backboard 10 with its attached molding 17, FIG. 2B, has socketed engagement in the supporting channel bar 24 throughout the entire length thereof for maximum stability in the support of the backboard and its attached hoop 12. The lower edge of the backboard is readily removable from the channel bar 24, when desired.

An independent upper pair of support brackets 28 for the goal is provided, the brackets 28 also having suspension hooks 29 identical to the hooks 26 and coacting with the apertures 19 of bars 18 in the same manner already described for the hooks 26. The upper support brackets 28 have forward vertical backboard support plates 30 welded thereto in parallel relationship to the bars 18 and backboard 10, and these plates are apertured at 31 to receive attaching bolts 32, FIG. 2A, which also engage through the upper backboard apertures 11 located to register with the apertures 31. It can be seen that the vertical backboard 10 is firmly supported continuously along its lower edge by the channel bar 24 and rigidly attached lower brackets 23 and near its two upper corners by the independent or unconnected brackets 28.

Adjustment of the goal vertically on the fixed apertured mounting bars 18 through a wide range is very simple. With the upper bolts 32 removed, the unitized lower brackets 23 may be raised or lowered to any desired new level on the bars 18 in the usual well-known manner by first elevating the hooks 29 and withdrawing them from the coacting apertures 19 and then re-inserting the hooks in a new set of apertures at a new elevation and lowering them into locking engagement with the bars 18, as shown in FIG. 2A. This mode of operation is conventional in commercial shelf brackets, as stated. After relocating the lower brackets 23 in this manner, the upper brackets 28 are similarly raised and lowered on the bars 18 and the top corners of the backboard 10 are rebolted to the brackets 28. This is the most convenient way to adjust the goal vertically.

It should now be apparent that an extremely stable and sturdy miniature basketball goal is provided by the invention which is readily adjustable. The entire structure is mountable on a door or wall by four screws and the invention makes use of the highly convenient and very secure shelf-type support brackets and coacting apertured mounting bars or channels 18. The structure is neat and has the required eye appeal for saleability and is entirely practical in all respects. The structure can be knocked down easily for compact storage and/or packaging.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A miniature adjustable basketball goal comprising a pair of laterally spaced vertically extending apertured support bars adapted to be fixedly mounted on a vertical support surface, a lower pair of mounting brackets having suspension hooks for entry into apertures of the support bars, a support channel permanently interconnecting said lower pair of mounting brackets and forming therewith a support unit, an upper pair of independent support brackets having hooks for entry into apertures of said support bars, a backboard and a basketball goal carried by the backboard, the lower edge of the backboard engaging in and being continuously supported by said support channel, and separable fasteners interconnecting upper corners of the backboard with said upper pair of independent support brackets.

2. A miniature adjustable basketball goal as defined in claim 1, and said lower pair of mounting brackets having notches in their upper edges and near their forward ends, and the opposite end portions of said support channel being seated in said notches.

3. A miniature adjustable basketball goal as defined in claim 2, and said opposite end portions welded to the lower pair of mounting brackets around the margins of said notches with the opposite end faces of the support channel flush with the outer side faces of said lower pair of mounting brackets.

4. A miniature adjustable basketball goal as defined in claim 1, and said separable fasteners comprising pairs of bolts, apertured vertical plates on the forward ends of the support brackets of said upper pair, and said backboard having pairs of apertures near its upper corners receiving said bolts and registering with the apertures of said vertical plates.

5. A miniature adjustable basketball goal as defined in claim 1, and channel molding strips on the marginal edges of said backboard enclosing such edges and imparting to the backboard a framed appearance, said backboard formed from transparent material.

6. A miniature adjustable basketball goal as defined in claim 1, and each apertured support bar having a multiplicity of equidistantly spaced apertures which are elongated longitudinally of the support bars, said hooks having engaging portions of slightly lesser lengths than the elongated apertures and having shanks at right angles to the engaging portions which are shiftable longitudinally of the elongated apertures.

7. A miniature adjustable basketball goal as defined in claim 1, and said basketball goal including an integral mounting bracket which is separably attached to said backboard.

8. A miniature adjustable basketball goal comprising a pair of laterally spaced vertically extending apertured support bars, each having a plurality of apertures therein to provide for vertical adjustment, adapted to be mounted on a vertical support surface, a plurality of mounting brackets having suspension hooks for entry into apertures of the support bars, each of said brackets having a U-shaped notch in its upper surface, an upwardly opening channel member extending between said brackets and fitted into said notches, said channel member and brackets being rigidly secured to form a support unit, a backboard and a basketball goal carried by the backboard, the lower edge of said backboard being received in and continuously supported by said channel member in parallel spaced relation to said vertical support.

9. A miniature adjustable basketball goal as defined in claim 8, and further characterized in that said backboard is formed from transparent materials and that said basketball goal includes an integral mounting bracket which is separably attached to said backboard.

* * * * *